United States Patent [19]

Wouk

[11] 4,435,671

[45] Mar. 6, 1984

[54] DEVICE FOR PROLONGING THE LIFE OF AN INCANDESCENT LAMP

[75] Inventor: Victor Wouk, New York, N.Y.

[73] Assignee: Eli, Inc., Cedar Grove, N.J.

[21] Appl. No.: 371,827

[22] Filed: Apr. 26, 1982

[51] Int. Cl.[3] ..... H05B 37/00

[52] U.S. Cl. ..... 315/200 R; 315/71; 315/362

[58] Field of Search ..... 315/200 R, 71, 72, 224, 315/362

[56] References Cited

U.S. PATENT DOCUMENTS

| | | | |
|---|---|---|---|
| 2,675,452 | 4/1954 | McMahan | 315/69 |
| 3,215,891 | 11/1965 | Fritz et al. | 315/50 |
| 3,234,437 | 2/1966 | Dumas | 357/79 |
| 3,237,272 | 3/1966 | Kallander | 29/25.3 |
| 3,241,010 | 3/1966 | Eddleston | 317/234 |
| 3,245,002 | 4/1966 | Hall | 331/94.5 |
| 3,256,466 | 6/1966 | Trolio et al. | 317/101 |
| 3,280,389 | 10/1966 | Martin | 317/234 |
| 3,310,716 | 3/1967 | Emeis | 357/81 |
| 3,328,650 | 6/1967 | Boyer | 357/79 |
| 3,372,302 | 3/1968 | Fasola | 315/272 |
| 3,440,496 | 4/1969 | Saia | 317/234 |
| 3,450,893 | 6/1969 | Munson | 305/146 |
| 3,467,937 | 9/1969 | Norton | 338/219 |
| 3,530,501 | 9/1970 | VanBenschoten | 315/129 |
| 3,689,392 | 9/1972 | Sandera | 204/192 |
| 3,771,018 | 11/1973 | Medendorp | 315/200 R |
| 3,818,263 | 6/1974 | Belko | 315/32 |
| 3,823,339 | 7/1974 | Borneman et al. | 315/69 |
| 4,229,680 | 10/1980 | Berlin et al. | 315/200 R |
| 4,350,931 | 9/1982 | Niskin | 315/200 R |

OTHER PUBLICATIONS

Publications by Starcrest and Power Disc, Inc., (5 pages).

*Primary Examiner*—Harold Dixon

*Attorney, Agent, or Firm*—Lerner, David, Littenberg, Krumholz & Mentlik

[57] ABSTRACT

A device for prolonging the life of an incandescent lamp includes a rectifier unit adapted for attachment to a lamp base and subsequent insertion into an appropriate lamp socket along with the lamp. The rectifier unit employs a leadless diode chip which is positioned off center within the socket so that the forces applied to the rectifier unit as the lamp is being screwed into the socket will not be applied directly to the diode chip. The rectifier unit also employs a pair of recessed electrical contacts attached to the diode chip and designed to minimize the distance that the unit raises the lamp in the socket and to conduct away the heat generated by the diode chip.

12 Claims, 2 Drawing Figures

DEVICE FOR PROLONGING THE LIFE OF AN INCANDESCENT LAMP

FIELD OF THE INVENTION

The present invention relates to a device for prolonging the life of an incandenscent lamp. The term "lamp" is used herein to describe what is more commonly referred to by the members of the general public as a "light bulb".

BACKGROUND OF THE INVENTION

Incandescent lamps wear out primarily because they operate at very high temperatures which cause their tungsten filaments to evaporate and weaken. The lamps burn out when their filaments break to a weakened thin spot.

In the past, devices have been developed for increasing the life of incandescent lamps by operating the lamps below their rated voltages. The prolonged life is a result of a substantial reduction in operating temperatures occasioned by the reduced operating voltages. For example, when operating voltage is reduced 30%, the life of a 120 volt lamp will be extended about 90.5 times longer than if it were operated at its rated voltage.

U.S. Pat. No. 3,823,339, which is owned by the assignee of the present invention, discloses one of these prior art devices in the form of a rectifier diode unit which includes a thin semiconductor wafer sandwiched between a pair of thin electrical contacts. When the unit is positioned between a lamp and a lamp socket, the semiconductor wafer lies directly between a contact provided on the lamp's base and a spring leaf contact positioned in the bottom of the socket. As a result of its location, the semiconductor wafer is susceptible to breakage and thus electrical failure from the forces applied to it as the lamp is screwed into the socket. This problem becomes more serious when the semiconductor wafer and its contacts are made extremely thin so as not to raise the lamp more than about 0.030 inches above its normal position in the socket with the rectifier diode unit removed. Such a height restriction is required, in addition to many other requirements, in order to obtain U.L. approval. Thus, in spite of the overall success of the rectifier diode unit disclosed in U.S. Pat. No. 3,823,339, it does have certain problems which leave room for improvement.

Other prior art devices have been developed which utilize laterally offset rectifier assemblies including encapsulated semiconductor diodes which are provided with arcuate electrical leads (see, for instance, U.S. Pat. Nos. 3,450,893 and 3,617,766). Because such semiconductor diodes are typically encapsulated within a glass or plastic casing which has poor thermal conducting properties, almost all of the heat generated by the diodes must be conducted away through the leads. However, the leads, which in addition to having a relatively small cross-sectional area, are also totally encapsulated, thereby further limiting the ability of these devices to conduct away the heat generated by the diodes. The current carrying capability of the diodes is inhibited when they become too hot. Thus, as a result of the encapsulation of the diodes and leads, the devices disclosed in U.S. Pat. Nos. 3,450,893 and 3,617,766 are effective only on lamps having a wattage rating sufficiently low to avoid overheating of the diodes, thereby limiting the devices to use in combination with relatively low wattage lamps. Also, because the leads must be attached by, for instance, soldering to a relatively complex contact assembly (see especially U.S. Pat. No. 3,450,893), these prior art devices can be fairly expensive to manufacture.

SUMMARY OF THE INVENTION

The present invention relates to a new and improved device for prolonging the life of an incandescent lamp while overcoming the problems and disadvantages of the prior art devices described above. More particularly, the new and improved device includes a rectifier unit sized and shaped for insertion into a lamp socket. The rectifier unit includes a housing having a first opening provided in one side of the housing and a second opening provided on an opposite side of the housing in general alignment with the first opening. A first electrical contact is positioned within the housing. The first electrical contact has an outer portion and an inner portion recessed relative to the outer portion and arranged in general alignment with the first opening in the housing. The inner portion of the first electrical contact is sized and shaped so as to engage a bottom contact of a lamp extending into the housing through the first opening therein. The housing also contains a second electrical contact, which has an outer portion arranged in general alignment with the outer portion of the first electrical contact and an inner portion recessed relative to the outer portion of the second electrical contact. The inner portion of the second electrical contact, which is sized and shaped so as to engage a spring leaf contact of a lamp socket, projects outwardly from the housing through the second opening therein. An electrical insulator is positioned within the housing between the first and second electrical contacts. The heart of the rectifier unit is a leadless diode chip positioned off center within the housing. The diode chip has a first contact surface arranged at one end of the diode chip and a second contact surface arranged at an opposite end of the diode chip. The first contact surface of the diode chip is in direct and substantially complete electrical engagement with the outer portion of the first electrical contact, while the second contact surface is in direct and substantially complete electrical engagement with the outer portion of the second electrical contact.

Because the contact surfaces of the diode chip are in direct and substantially complete electrical engagement with the first and second electrical contacts, the heat generated by the diode chip can be effectively and quickly conducted away to inhibit its overheating. The ability of the first and second electrical contacts to conduct heat is further enhanced by their relatively large surface areas in comparison to the surface area of the contact surfaces of the diode chip. Because the diode chip is laterally offset from the lamp contact and the spring leaf contact of the lamp socket, the forces applied to the rectifier unit as the lamp is being screwed into the lamp socket are not applied directly to the diode chip, thereby reducing the chances that such forces might fracture or otherwise damage the diode chip. The recessed design of the first and second electrical contacts is also advantageous inasmuch as it permits the distance between the lamp contact and the spring leaf contact of the lamp socket to be minimized, thereby minimizing the distance that the rectifier unit raises the lamp in the lamp socket.

In a preferred embodiment of the present invention, the diode chip is positioned in an annular air chamber within the housing of the rectifier unit. In this embodiment, the heat generated by the diode chip is also conducted away by convection as a result of the heating of the air in the annular chamber.

BRIEF DESCRIPTION OF THE DRAWINGS

For a more complete understanding of the present invention, reference is made to the following detailed description of an exemplary embodiment considered in conjunction with the accompanying drawings, in which.

DESCRIPTION OF THE EXEMPLARY EMBODIMENT

Figure 1:
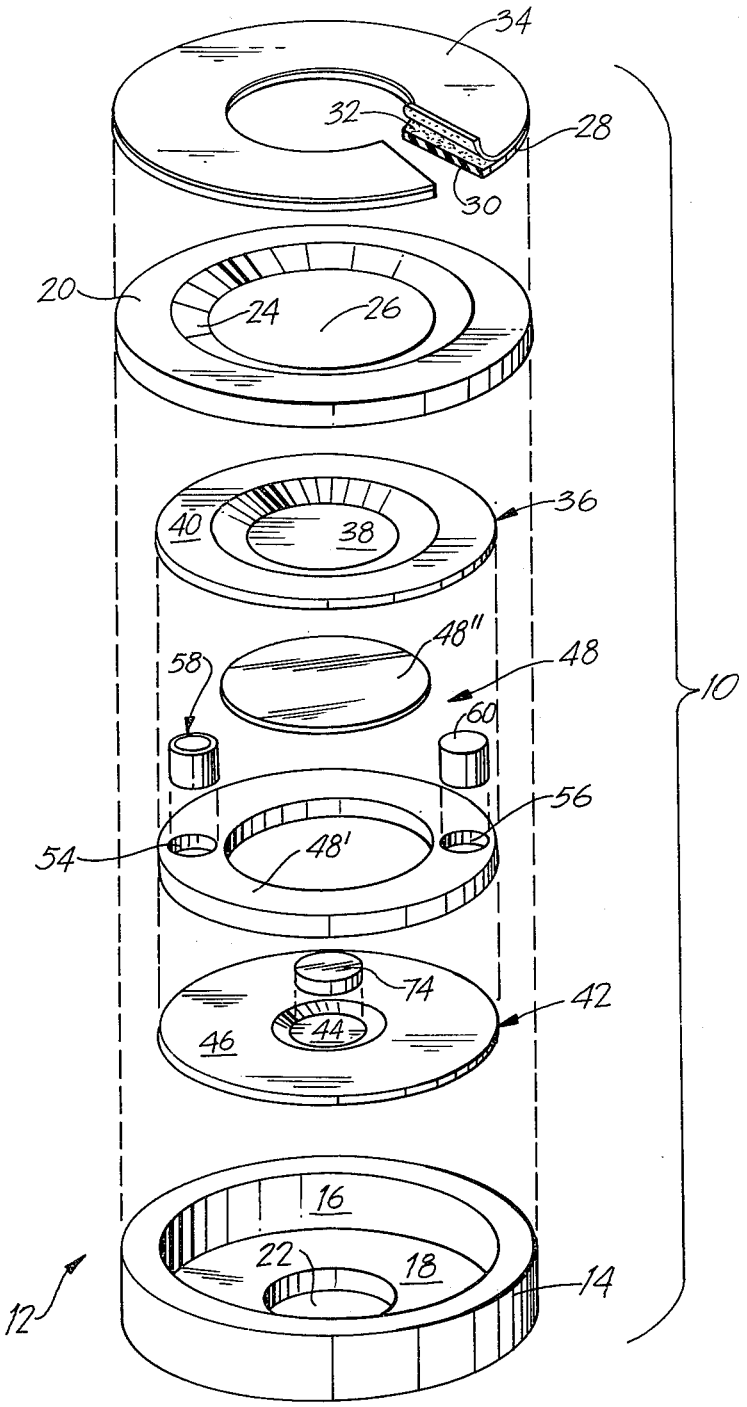
FIG. 1 is an exploded view of one embodiment of a rectifier unit constructed in accordance with the present invention.

Referring primarily to FIG. 1 of the drawings, there is shown a half-wave rectifier unit 10 for prolonging the life an incandescent lamp (not shown). The rectifier unit 10 includes a housing 12 made from a high-temperature resistant plastic. The housing 12 includes a base 14, having an annular sidewall 16 and an end wall 18, and a crown 20 which is fixedly attached to the sidewall 16 of the base 14. A centrally located opening 22 is provided in the end wall 18 of the base 14. The crown 20 has an inner bevelled edge 24, which defines another opening 26 in the housing 12. The opening 26 is arranged concentrically with the opening 22. A rubber gasket 28 is adhesively attached to the crown 20 by a layer of high-temperature resistant adhesive 30. Another layer of high-temperature resistant adhesive 32 is applied to an opposite side of the gaske 28. A paper or plastic ring 34 is removably applied to the adhesive layer 32 to protect it until the rectifier unit 10 is ready for use. The inner diameter of the gasket 28 is slightly less than the diameter of the eyelet contact of a lamp base (see FIG. 2), so that the gasket 28 can mechanically grip the base to thereby cooperate with the adhesive layer 32 in attaching the rectifier unit 10 to the lamp.

A dish-shaped electrical contact 36 is contained within the housing 12. The contact 36, which extends completely across the inner diameter of the housing 12, includes a recessed inner portion 38 and an annular outer portion 40 surrounding the recessed inner portion 38. The housing 12 also contains another dish-shaped electrical contact 42, which is provided with a recessed inner portion 44 and an annular outer portion 46 surrounding the recessed inner portion 44. The contact 42 also extends completely across the inner diameter of the housing 12. Both of the contacts 36, 42 are made from a suitable metal, such as copper.

An electrical insulator 48 is interposed between the contacts 36, 42 to electrically isolate them from each other. The insulator 48, which includes an outer collar 48' and an inner disc 41", cooperates with the contacts 36, 42 to form an annular air chamber 50 (see FIG. 2) between the collar 48' and the outer portion 40 of the contact 36 and another chamber 52 (see FIG. 2) between the disc 48" and the recessed inner portion 44 of the contact 42. The collar 48' has a pair of holes 54, 56. The hole 54 is sized and shaped so as to receive one end of a cylindrical diode chip 58 positioned in the annular air chamber 50. The hole 56 is sized and shaped so as to receive one end of an electric insulating spacer 60 positioned in the annular air chamber 50 diametrically opposite the diode chip 58. The holes 54, 56 are formed in inner regions of the collar 48', so that the diode chip 58 and the spacer 60 will be located in the middle of the annular air chamber 50. The collar 48' and the disc 48" can be made from any suitable electrical insulating material, such as mica.

The diode chip 58, which can be model no. S-3A4CO manufactured by Semicon, includes a silicon wafer or semiconductor diode 62 sandwiched between a pair of metallic heat sinks 64, 66 (see FIG. 2). Contact surfaces 68, 70 are provided on the heat sinks 64, 66, respectively (see FIG. 2). The contact surfaces 68, 70 make direct mechanical and electrical engagement with the outer portions 40, 46 of the contacts 36, 42, respectively, thereby electrically connecting the contacts 36, 42 to each other through the diode chip 58. In order to inhibit moisture from contacting the silicon wafer 62 and the heat sinks 64, 66, they are jacketed in a silastic coating 72 of some other suitable type of coating. Because the diode chip 58 does not have to be welded or soldered to the contacts 36, 42, the assembly of the rectifier unit 10 is simplified.

The spacer 60 is positioned diametrically opposite the diode chip 58 so as to stabilize and support the contact 36, thereby facilitating good mechanical and electrical contact between the contact surface 68 of the diode chip 58 and the outer portion 40 of the contact 36. The spacer 60 is made from a mateial which, in addition to being an electrical insulator, is also resistant to high temperatures. Although the spacer 60 has a cylindrical shape, any other suitable shape may be employed.

The chamber 52 formed between the insulating disc 48" and the recessed inner portion 44 of the contact 42 houses a metallic plug 74, which mechanically supports the insulating disc 48" to inhibit it from being accidentally or inadvertently fractured. If the insulating disc 48" is strong enough, the plug 74 may be omitted from the chamber 52. Also, for some applications, the plug 74 may be made from a non-metallic material.

In order to prepare the rectifier unit 10 for its initial use, the plastic or paper ring 34 is peeled off of the adhesive layer 32 to expose it. The rectifier unit 10 is then attached to an incandescent lamp by inserting the lamp's base through the gasket 28 and then pressing the base against the exposed adhesive layer 32. With the rectifier unit 10 in place, the lamp can be screwed into an appropriate socket, such as a spotlight socket, a candelabra socket or a standard lamp socket. The forces produced as the lamp is screwed into the socket and the heat generated when the lamp is in operation enhance the effectiveness of the adhesive attachment between the lamp and the adhesive layer 32. Thus, when the lamp is removed from the socket, the rectifier unit 10 remains attached to the lamp base. Once the lamp has been removed from the socket, the rectifier unit 10 may be removed from the lamp's base and reapplied to another lamp.

Figure 2:
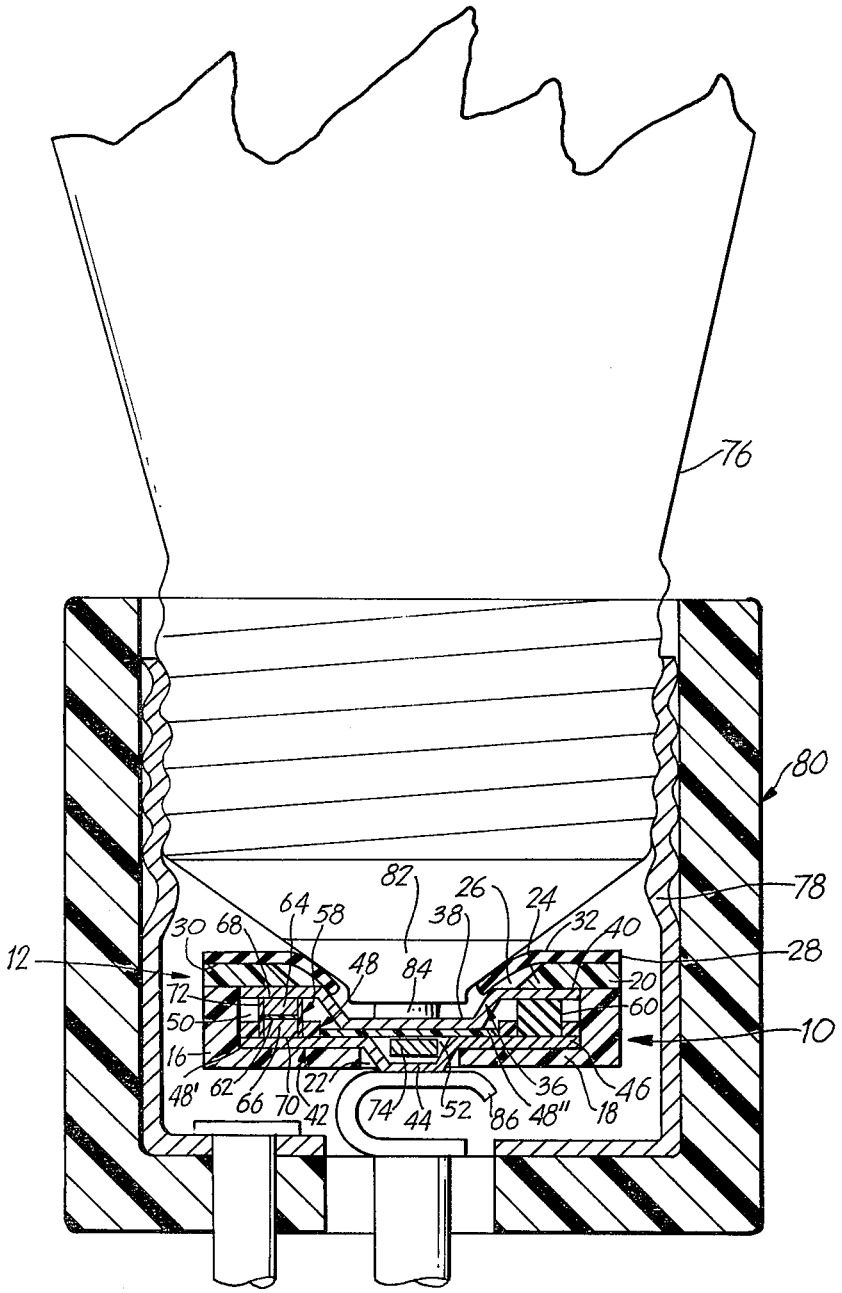
FIG. 2 is an axial cross-sectional view of a lamp and lamp socket employing the rectifier unit of FIG. 1.

Referring now solely to FIG. 2, the rectifier unit 10 is shown attached to an incandescent lamp 76 which has been screwed into a threaded shell 78 of a conventional lamp socket 80. More particularly, the rectifier unit 10 is attached to a base 82 of the lamp 76 by the exposed adhesive layer 32 on the gasket 28, which is sufficiently resilient to conform to the general conical shape of the base 82. The base 82 of the lamp 76 is provided with a contact 84 which makes electrical engagement with the recessed inner portion 38 of the contact 36 of the rectifier unit 10. The recessed inner portion 44 of the other contact 42 of the rectifier unit 10 is in electrical engagement with a spring leaf contact 86 located in the bottom of the socket 80. Because the diode chip 58 is laterally offset from the contact 84 on the base 82 of the lamp 76 and the spring leaf contact 86 of the socket 80, the forces applied to the rectifier unt 10 as the lamp 76 is being screwed into the shell 78 of the socket 80 are not applied directly the diode chip 58, thereby reducing the chances that such forces might fracture or otherwise damage the silicon wafer 62 of the diode chip 58.

Typically, the recessed inner portion 44 of the contact 42 protrudes about 0.0015 inches beyond the opening 22 in the end wall 18 of the housing 12, the end wall 18 being about 0.0155 inches thick. The contact 42 itself has a thickness of about 0.005 inches, which is about the same thickness as the contact 36. The thickness of the insulating disc 48" is about 0.003 inches. Thus, the maximum distance that the rectifier unit 10 raises the lamp 76 (i.e., the distance between the contact 84 on the base 82 of the lamp 76 and the spring leaf contact 86 of the socket 80) is no more than the 0.030 inches required for U.L. approval.

When the rectifier unit 10 is in use, the diode chip 58 generates heat, which could have a deleterious effect on the diode chip 58 if not conducted away. Because the heat sinks 64, 66 of the diode chip 58 are in direct and substantially complete mechanical and electrical contact with the outer portions 40, 46 of the contacts 36, 42, respectively, the heat generated by the diode chip 58 can be effectively and quickly conducted away to inhibit its overheating, whereby the rectifier unit 10 may be used with lamps having wattage ratings as high as 300 watts. The ability of the contacts 36, 42 to conduct heat is further enhanced by their relatively large surface area resulting from their dish-shaped design. The heat generated by the diode chip 58 is also conducted away to some extent by convection as a result of the heating of the air in the annular chamber 50.

It will be understood that the embodiment described herein is merely exemplary and that a person skilled in the art may make many variations and modifications without departing from the spirit and scope of the invention. All such modifications and variations are intended to be included within the scope of the invention as defined in the appended claims.

I claim:

1. A device for prolonging the life of an incandescent lamp, comprising a rectifier unit sized and shaped for insertion into a lamp socket, said rectifier unit including a housing having a first opening provided in one side of said housing and a second opening provided in an opposite side of said housing, said second opening being in general alignment with said first opening, a first electrical contact positioned within said housing, said first electrical contact having an outer portion and an inner portion recessed relative to said outer portion of said first electrical contact and arranged in general alignment with said first opening in said housing, said inner portion of said first electrical contact being sized and shaped so as to engage a bottom contact of a lamp extending into said housing through said first opening therein, a second electrical contact positioned within said housing, said second electrical contact having an outer portion arranged in general alignment with said outer portion of said first electrical contact and an inner portion recessed relative to said outer portion of said second electrical contact and projecting outwardly from said housing through said second opening therein, said inner portion of said second electrical contact being sized and shaped so as to engage a spring leaf contact of a lamp socket, an electrical insulator positioned within said housing between said first and second electrical contacts, and a leadless diode chip positioned off center within said housing, said diode chip having a first contact surface arranged at one end of said diode chip, said first contact surface being in direct and substantially complete electrical engagement with said outer portion of said first electrical contact, and a second contact surface arranged at an opposite end of said diode chip, said second contact surface being in direct and substantially complete electrical engagement with said outer portion of said second electrical contact.

2. A device for prolonging the life of an incandescent lamp according to claim 1, wherein said rectifier unit further includes a resilient gasket having an inner surface attached to said one side of said housing and an outer surface opposite said inner surface of said gasket, said gasket overhanging said first opening in said housing.

3. A device for prolonging the life of an incandescent lamp according to claim 2, wherein said gasket further includes a layer of adhesive applied to said outer surface thereof and a protective shield removably applied to said layer of adhesive on said outer surface of said gasket.

4. A device for prolonging the life of an incandescent lamp according to claim 3, wherein said layer of adhesive has an adhesiveness selected such that said layer of adhesive adhesively attaches said rectifier unit to a lamp base.

5. A device for prolonging the life of an incandescent lamp according to claim 4, wherein said gasket has an inner diameter selected such that said gasket mechanically grips an eyelet contact of a lamp base.

6. A device for prolonging the life of an incandescent lamp according to claim 1, wherein said rectifier unit further includes a spacer positioned within said housing and extending between said outer portion of said first electrical contact and said outer portion of said second electrical contact.

7. A device for prolonging the life of an incandescent lamp according to claim 6, wherein said rectifier unit further includes positioning means for positioning said diode chip and said spacer diametrically opposite each other.

8. A device for prolonging the life of an incandescent lamp according to claim 7, wherein said positioning means includes a pair of holes in said electrical insulator, one of said holes being sized and shaped so as to receive said diode chip and the other of said holes being sized and shaped so as to receive said spacer.

9. A device for prolonging the life of an incandescent lamp according to claim 8, wherein said electrical insulator extends completly across said housing, said electrical insulator including an outer collar and an inner disc positioned within said outer collar.

10. A device for prolonging the life of an incandescent lamp according to claim 1, wherein said rectifier unit further includes a plug positioned between said electrical insulator and said inner portion of said second electrical contact.

11. A device for prolonging the life of an incandescent lamp according to claim 1, wherein said first and second electrical contacts are substantially dish-shaped.

12. A device for prolonging the life of an incandescent lamp according to claim 1, wherein said rectifier unit further includes an annular air chamber between said first electrical contact and said electrical insulator, said diode chip being positioned in said annular air chamber.

* * * * *